US006539826B2

(12) United States Patent
Oesterle et al.

(10) Patent No.: US 6,539,826 B2
(45) **Date of Patent: *Apr. 1, 2003**

(54) SCREWING ELEMENT

(75) Inventors: Helmut Oesterle, Feldkirch (AT); Norbert Koeppel, Au (CH); Felix Scheiwiller, Diepoldsau (CH); Peter Kouwenhoven, Widnau (CH)

(73) Assignee: SFS Industrie Holding AG, Heerbrugg (CH)

( * ) Notice: Subject to any disclaimer, the term of this patent is extended or adjusted under 35 U.S.C. 154(b) by 0 days.

This patent is subject to a terminal disclaimer.

(21) Appl. No.: 09/873,527

(22) Filed: Jun. 4, 2001

(65) Prior Publication Data

US 2001/0025553 A1 Oct. 4, 2001

Related U.S. Application Data

(63) Continuation of application No. 09/381,609, filed as application No. PCT/EP98/00871 on Feb. 16, 1998, now Pat. No. 6,240,811.

(30) Foreign Application Priority Data

Mar. 26, 1997 (DE) ..... 197 12 783

(51) Int. Cl.[7] ..... B25B 13/28
(52) U.S. Cl. ..... 81/90.2; 81/90.3; 81/90.9
(58) Field of Search ..... 81/90.2, 90.3, 81/90.5, 90.9, 111, 112, 113, 114, 115

(56) References Cited

U.S. PATENT DOCUMENTS

| | | | | |
|---|---|---|---|---|
| 1,583,554 A | | 5/1926 | Hoover | |
| 1,807,265 A | | 5/1931 | Walker | |
| 2,434,354 A | | 1/1948 | Emmons | |
| 2,579,438 A | | 12/1951 | Longfellow | |
| 2,634,641 A | | 4/1953 | Hodges | |
| 3,210,836 A | * | 10/1965 | Johanson et al. | 29/278 |
| 3,339,439 A | * | 9/1967 | Dalen et al. | 81/112 |
| 4,022,086 A | * | 5/1977 | Ramsey | 81/112 |
| 5,218,890 A | * | 6/1993 | Christ, Jr. | 81/113 |
| 6,240,811 B1 | * | 6/2001 | Oesterle et al. | 81/90.2 |

FOREIGN PATENT DOCUMENTS

| | | |
|---|---|---|
| FR | 15845 E | 10/1912 |
| FR | 145069 E | 10/1922 |

* cited by examiner

*Primary Examiner*—George Nguyen
*Assistant Examiner*—Dung Van Nguyen
(74) *Attorney, Agent, or Firm*—Volpe and Koenig PC

(57) ABSTRACT

In a screwing element (1) for accommodation of a fastener head (5) of a fastener (6) there are provided jaws (3, 4) for seizing the fastener head. The jaws (3, 4) can be axially inserted into or withdrawn from the holder (2), wherein the jaws in the withdrawn position can be pivotably forced apart into open position. At their free end the jaws are provided with incisions (15, 16) and, adjoining these, with gripper-like parts (17, 18) jutting outwardly toward the central axis for the purpose of engaging mechanically and/or frictionally with the fastener head (5) from behind.

3 Claims, 2 Drawing Sheets

SCREWING ELEMENT

This application is a continuation of U.S. patent application Ser. No. 09/381,609, filed Sep. 22, 1999, now U.S. Pat. No. 6,240,811 entitled Screwing Element, which is a 371 National Phase Application of International Application No. PCT/EP 98/00871 filed date Feb. 16, 1998.

The invention relates to a screwing element for holding and for forcibly turning a fastener, with a plurality of jaws, which are disposed in succession in circumferential direction for seizing the fastener, wherein the jaws engage in a tubular holder and, in cooperation with this holder, in a first end position can be forced radially apart for the purpose of holding the fastener, and in a second end position can be radially squeezed toward each other by mechanical action of the holder in response to application of axial and/or radial force.

Such screwing elements have become known in a plurality of different embodiments. As a rule, such screwing elements have a recess for accommodating the fastener head, wherein the recess as viewed in axial direction has a cross section matched to the cross section of the fastener head, so that torque can be transmitted while the fastener is being driven in. Accordingly a fastener is guided axially with its head in the recess in such a screwing element. Spring-loaded pins or balls can also be disposed, for example, to prevent the head of a fastener from slipping out spontaneously after it has been inserted in the screwing element. Thus captive protection is achieved at least temporarily. If such a fastener is to be driven into a corresponding workpiece, however, then axial force transmission is also needed, and so appropriate stop elements must in turn be provided in a screwing element in order to limit movement toward the screwing element. Since the diameter of the threaded shank of the fastener is normally much smaller than the diameter of the fastener head, it is usually even necessary to provide centering for the shank, in order that proper setting of the fastener can be achieved at all.

The object of the present invention is therefore to provide a screwing element of the type mentioned in the introduction; with which element a fastener head or portions of a fastener head can be immobilized in axial direction during setting of a fastener, specifically until the fastener is finally tightened.

This object is achieved according to the invention by the fact that incisions or recesses are formed on the free end region of the jaws for mechanical and/or frictional accommodation of a fastener head, and that gripper-like parts jutting outwardly toward the central axis or directed away therefrom are formed on the free end of the jaws, adjoining the incisions or recesses, for the purpose of additional mechanical and/or frictional seizing of portions of the fastener head.

By means of the screwing element according to the invention, the fasteners to be inserted can be clamped in the region of the fastener head in such a way that they can no longer be moved in axial direction, and that they remain axially aligned with the screwing element throughout the entire setting process and thus permit optimal drive action by a driving tool. Because of the radial squeezing effect of corresponding jaws, not only can the fastener head be seized exactly, but also corresponding engagement with the fastener head from behind is possible without the need for additional stop elements and studs or balls which spring back under spring loading.

To achieve particularly good alignment between screwing element and fastener and to permit exact clamping of the fastener head, it is provided that the incisions, recesses or the like on the jaws correspond at least approximately to the cross section of the rim region of the fastener head to be seized or of a shoulder formed thereon. The screwing element or the jaws thereof can be adapted to a specially formed fastener, to the effect that a highly special screwing element, with which the fasteners can also be optimally set, is available for a given individual application.

In order to achieve proper torque transfer during a boring process, a thread-forming process or merely during the process of driving in a fastener, it is proposed that, in the region of the incisions, recesses or the like or adjoining these at offset position in axial direction or even on the gripper-like parts or openings or profiled structures, there be provided extensions of a tool for acting on a fastener head or on portions thereof. In this way optimal torque transfer is achieved in addition to the mechanical holding effects of the jaws, by the fact that extensions of a tool are provided precisely in the affected regions of the jaws.

In this connection it is advantageous for the jaws to be spring-loaded toward their open position. Thus, when the jaws are in open position, they are always pivoted away from each other, and so no problems of any kind occur for insertion of the next fastener.

To ensure that the jaws do not come into contact with the surface of the workpiece until a fastener has just been finally set, it is provided that the thickness of the gripper-like portions viewed in axial direction of the screwing element is smaller than the axial length of a fastener-head portion which on the shank side adjoins a shoulder formed circumferentially on the fastener head. In all cases, therefore, the lowest edge of the jaws and thus of the gripper-like parts is still disposed at a corresponding distance from the surface of the workpiece, and so the fastener head can be immobilized until setting has just been completed, without scratching of the workpiece-surface.

A simple structural variant provides that, on the inside of the holder and/or on the outside surface of the jaws, there are formed camming surfaces which taper sharply relative to the central axis, wherein the jaws can be squeezed toward each other by the camming surfaces in response to being forced axially into the holder. In this way forced closing of the jaws can be achieved with simple means, specifically merely by pushing the fastener axially inward, wherein the fastener head acts appropriately on the jaws. If axial pressure is additionally exerted by the driving tool during the setting process, the sharply tapering camming surfaces generate an additional radial component of force, thus clamping the fastener head even more forcefully during the process of setting of the fastener.

To ensure that satisfactory force transmission can occur, it is advantageous for sharply tapering camming surfaces to be provided on both the holder and on the jaws.

In a particular structural variant, it is further provided that the jaws are equipped at their ends protruding into the tubular holder with radially inwardly directed toes, which engage in a radially circumferential groove of a stud that is axially slidable in the screwing element and can be fixed in a plurality of latching positions, wherein this stud can be positioned together with the jaws by the action of axial pushing or pulling thereon.

In this way the jaws are secured not only in axial direction and thus held captively, but thereby can also be brought into a specific open end position and closed end position in cooperation with the stud. Since the jaws in one of their end positions remain in the closed position, the fastener head cannot fall out downward again, even during assembly, after insertion between the jaws. In this precise connection it is advantageous for the stud to be fixed latchingly at least in the two end positions of the jaws.

For this purpose it is proposed that the stud be provided with at least two latching positions formed by circumferential grooves, wherein a spring-loaded pin or a ball which engages in the corresponding circumferential groove is held against the tubular holder. Thereby there are created secure latching positions, which prevent inadvertent maladjustment of the jaws in the open position and in the closed position.

To achieve optimal cooperation between the stud and the jaws cooperating mechanically or frictionally with the stud, it is proposed that the stud, on its portion adjoining the groove for engagement with the toes formed on the jaws, be adapted to the inside cross section of the jaws in closed condition, wherein the transition between the groove and the end part of the stud and the corresponding regions of the jaws are spherically convex. This ensures not only exact guidance between the stud and the jaws, but also exact pivoting capability without tilting and thus without operating disturbances for the screwing element.

Further technical possibilities are achieved by the construction of a screwing element according to the invention. In one particular embodiment, for example, a tool for an internal drive can be formed at the center between the jaws. In such a case the jaws are needed practically only for immobilizing and axially aligning the fastener, whereas the motive power for driving in can be provided via an internal drive. In such a construction it is particularly advantageous for the tool for an internal drive to be formed or disposed at the free end of the stud which is slidable in the tubular holder. This stud slides together with the jaws and always occupies the same axial position relative to the jaws, so that it is very simple to equip the free end of this stud with the appropriate internal drive. Since the fastener head is axially immobilized, the internal drive also cannot be forced out of the corresponding recess of the fastener head. Thereby a relatively high torque can be transmitted, even when the length of axial engagement offered by the internal drive is relatively small.

In an advantageous alternative embodiment, it is proposed that the jaws be squeezed resiliently toward each other by an O-ring inlaid in a groove on the outside circumference of the jaws in the region of the inwardly projecting toes, so that the jaws are pressed apart into open position when in their position withdrawn from the holder. Thus there is created a structurally very simple variant, which on the one hand generates the resilient effect and on the other hand creates corresponding retention of the jaws relative to the stud.

Another embodiment provides that compression springs are inserted between the jaws in the region of their free ends, so that the jaws, when in their position withdrawn from the holder, are forced apart into open position. By these features there is achieved practically the same effect, since the intended purpose in both embodiments is that the ends of the jaws protruding into the holder or the toes thereof remain constantly pressed against the stud.

To achieve optimal retention of an inserted fastener head, it is proposed that the gripper-like parts each be extended over the entire sector region of the jaws. In this way the best possible all-around retention over the circumference of the fastener head is assured. An optimal and very simple construction is further achieved by providing two jaws extending approximately over an angular region of 180°.

Further features and special advantages according to the invention are explained in further detail in the description given hereinafter with reference to the drawings, wherein.

Figure 1:
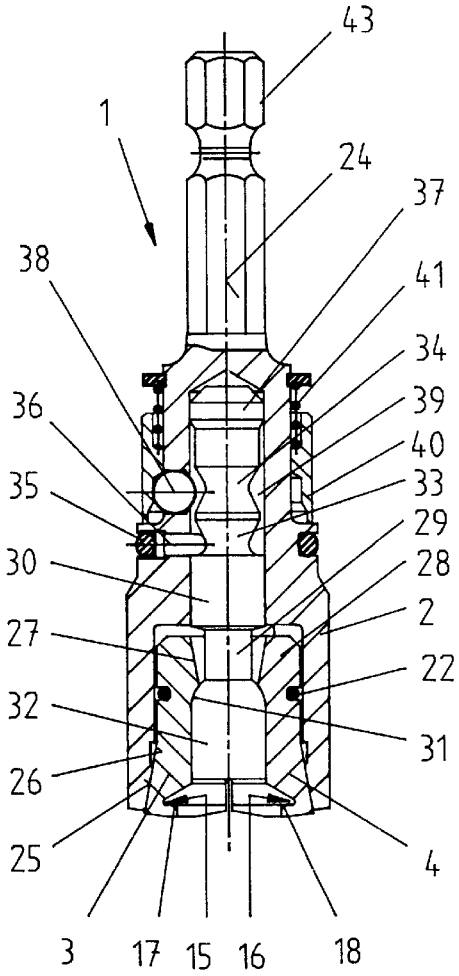
FIG. 1 shows a section through a screwing element, wherein the jaws are illustrated in closed condition.
Figure 2:
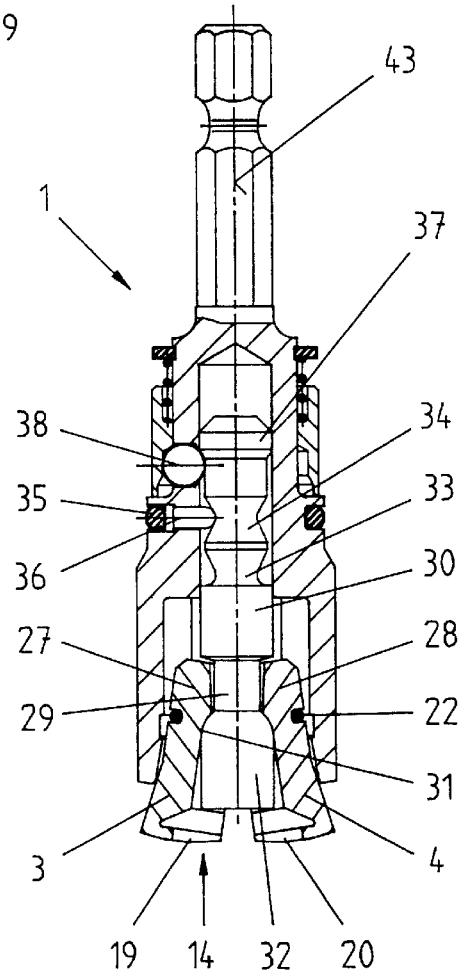
FIG. 2 shows the same screwing element, also illustrated in longitudinal section, wherein the jaws are disposed in their open position.
Figure 4:
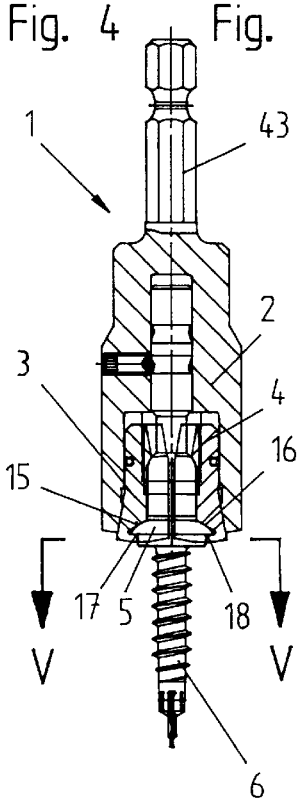
Figure 6:
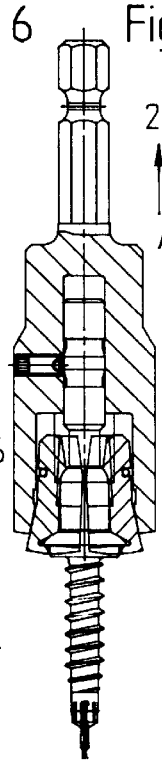
Figure 7:
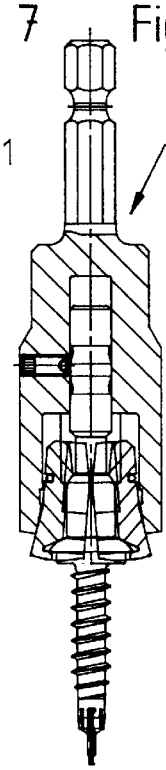
Figure 8:
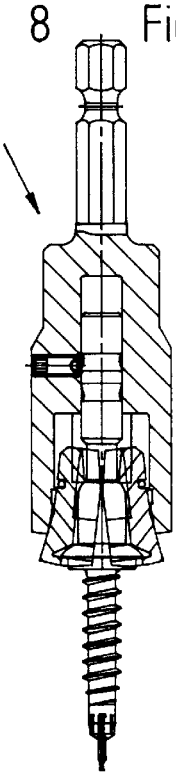
Figure 9:
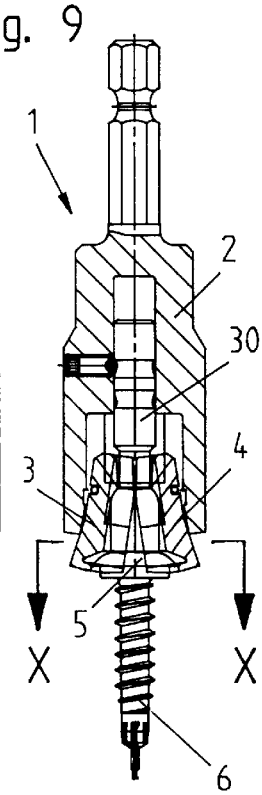
Figure 5:
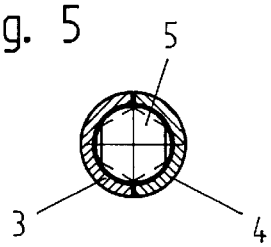
Figure 11:
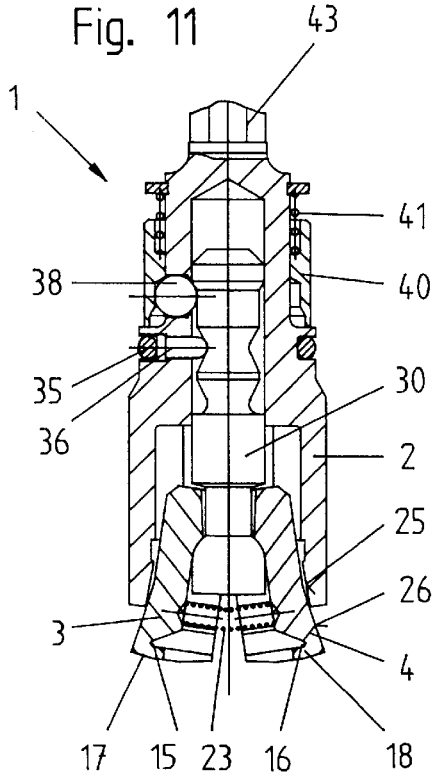
Figure 10:
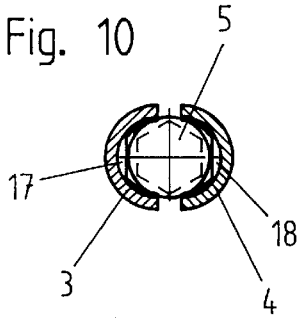

FIG. 4 and FIG. 6 to FIG. 9 each show longitudinal sections through a screwing element according to FIGS. 1 and 2 with an inserted fastener, wherein various positions of the jaws inside the screwing element are illustrated;

FIG. 5 and FIG. 10 show sections through lines V—V and X—X respectively in FIGS. 4 and 9;

FIG. 11 shows a screwing element according to a different alternative embodiment, wherein only the spring means for retention in open position have been changed compared with the embodiment according to FIGS. 1 and 2.

Screwing element 1 according to FIGS. 1 and 2 comprises substantially a tubular holder 2 and two jaws 3 and 4, and is used to accommodate a fastener head 5 and to hold the same or to drive the same and thus to drive in a fastener 6. Fastener 6 is provided with an appropriate shank 7 and a thread 8, and if necessary can also be equipped with a boring part 9. Fastener head 5 has a shoulder 10, which is separated by length B from bearing face 11 of the head. In the example of a fastener shown here, there is provided under shoulder 10 a portion 12, which is smaller in dimensions than shoulder 10 and for practical purposes is covered almost completely thereby. Portion 12 is equipped with a tool drive 13, which in the present case, for example, is hexagonal.

The purpose of screwing element 1 according to the invention is now to create a possibility of holding a fastener 6 securely and axially aligned during a boring and/or thread-forming process and/or during a driving-in process, and of transferring the appropriate torque from the screwing element to fastener 6.

As already mentioned, two jaws 3 and 4 are present, although in the scope of the invention there can also be provided a plurality of jaws for seizing fastener head 5 successively in circumferential direction. Jaws 3, 4 engage in tubular holder 2, and in cooperation therewith can be closed or forced apart.

In their one end position (FIG. 2), jaws 3, 4 can be forced radially apart in order to insert a fastener head 5. Upon application of axial force on jaws 3, 4 in the direction of arrow 14, jaws 3, 4 are forcibly squeezed toward each other in radial direction (position according to FIG. 1) by the mechanical interaction between holder 2 and jaws 3, 4. At the free end region of jaws 3, 4 there are provided incisions 15, 16, with which mechanical and/or frictional accommodation of a fastener head 5 or else of portions of a fastener head can be achieved. In the case of the special screw according to FIG. 3, only the portion of fastener head 5 forming shoulder 10 is accommodated in incisions 15, 16 of jaws 3, 4. At the free end of jaws 3, 4, adjoining the incisions or corresponding recesses of other form, there are provided gripper-like parts 17, 18 jutting outwardly toward the central axis, in order thereby to create the possibility of engaging with fastener head 5 or portions thereof, such as shoulder 10, from behind by mechanical or frictional action.

Incisions 15, 16 on jaws 3, 4 correspond at least approximately to the cross section of the rim region of fastener head 5 to be seized or of shoulder 10 formed thereon. On gripper-like parts 17, 18 there are provided extensions 19, 20 of a tool for acting on fastener head 5 or on tool drive 13 in the region of portion 12.

As can be inferred from FIGS. 4 and 5 in this connection, fastener head 5 is clamped securely between the two jaws 3 and 4 in the position of screwing element 1 as also illustrated in FIG. 1, wherein gripper-like parts 17, 18 engage with shoulder 10 from behind or from underneath and become braced together with these gripper-like parts on tool drive 13 of fastener head 5. In such a clamped form, fastener 6 can be held in clamped condition until it has been finally driven into the workpiece by the screwing element, since even the one part of gripper-like parts 17, 18 engaging with the one part of fastener head 5 from underneath cannot bear on the workpiece surface. If screwing element 1 is subsequently removed in the direction of arrow 21 from fastener 6 or from fastener head 5 once fastener 5 [sic] has been set, jaws 3, 4 are pulled out of holder 2 and ultimately occupy a position as illustrated in FIGS. 9 and 10. In this position the two jaws 3 and 4 are forced sufficiently apart in their open position that fastener head 5 is released. The screwing element can now be raised upward in the direction of arrow 21, thus preparing it for accommodation of the next fastener 6, which merely has to be pressed into the screwing element, with fastener head 5 leading. By virtue of the axial load on jaws 3, 4, these are pushed into holder 2, so that jaws 3, 4 ultimately reach the closed position, in which fastener head 5 is immobilized.

Jaws 3, 4 can therefore be pivoted mechanically and/or frictionally into their closed or open position by axial movement in tubular holder 2. The simplest embodiment is that in which mechanical retention is achieved in closed position while not only mechanical locking by means of an appropriate spring but also frictional locking is provided in open position. Jaws 3, 4 are therefore expediently spring-loaded in the direction of their open position, wherein jaws 3, 4 in the examples according to FIGS. 1 and 2 are squeezed resiliently toward each other by an O-ring 22 inlaid in a groove on the outer circumference of jaws 3, 4, specifically in the region of their ends protruding into holder 2. Thereby the jaws together with their ends projecting beyond the holder are forced apart into open position.

The only difference between the embodiment according to FIG. 11 and the alternative embodiment according to FIGS. 1 and 2 is that compression springs 23 are inserted between the jaws, in the region of their free ends, and so the jaws are forced apart to open position when in their position withdrawn from holder 2.

On the inside of holder 2 and on the outside of jaws 3, 4 there are provided camming faces 25, 26 running at a sharp angle relative to central axis 24 of the screwing element, so that jaws 3, 4 are squeezed toward each other when pushed axially inward in the direction of arrow 14. Expediently, corresponding camming surfaces 25, 26 will be provided both on holder 2 and on jaws 3, 4: It would also be conceivable, however, to form corresponding sharply tapering camming surfaces only on holder 2 or only on jaws 3, 4. For proper and smooth function, however, it is practical to form appropriate camming faces which correspond to each other on two regions adjacent to one another.

At their ends protruding into tubular holder 2, jaws 3, 4 are provided with radially inwardly directed toes 27, 28, which engage in a radially circumferential groove 29 of a stud 30 which is axially slidable in screwing element 1. At its portion 31 adjoining groove 29 for engagement of toes 27, 28, stud 30 is adapted to the inside cross section of jaws 3, 4 in closed condition. Portion 31, which forms the transition between groove 29 and end part 32 of stud 30, advantageously has spherically convex shape, and the inside regions of jaws 3, 4 are also shaped correspondingly. For practical purposes, therefore, a kind of ball-and-socket joint is created between stud 30 and jaws. 3, 4, and so stud and jaws can slide optimally over each other, thus ensuring optimal pivotability from the closed position of jaws 3, 4 to the open position thereof.

Stud 30 together with the jaws is positioned in the direction of axis 24 by application of appropriate axial pressure and/or tension on jaws 3, 4. At its end protruding into holder 2, stud 30 is provided with circumferential grooves 33 and 34, in which there can engage a pin 36 spring-loaded by an O-ring 35, for example, or an appropriate ball. Spring-loaded pin 36 thus engages in one of the grooves 33 and 34 when stud 30 is at least in the region of its two end positions, thus additionally ensuring further frictional retention of stud 30 and thus of the jaws in the two end positions. Instead of spring-loaded pin 36, it would of course also be possible to provide appropriately spring-loaded balls or the like, which engage in appropriately circumferential groove 33 or 34.

At the free end, stud 30 is provided with a circumferential shoulder 37, which is larger in diameter than the portion of stud 30 provided with the two grooves 33 and 34. A ball 38, which protrudes partly into the region of bore 39 in holder 2 and thus prevents stud 30 from being completely pulled out, is held secured against axial displacement in holder 2. Circumferential shoulder 37 is prevented from further shifting by ball 38 protruding into bore 39.

However, when a sleeve 40 which fits over tubular holder 2 is raised against the force of a helical spring 41, ball 38 is also released to a certain extent, and so stud 30 can be completely withdrawn from bore 39. Thereby it is also easily possible to replace jaws 3, 4 and stud 30 and also to disassemble and reassemble them for other purposes.

Gripper-like parts 17, 18 expediently extend over the entire sector region of jaws 3, 4. It is also entirely conceivable, however, to provide here only individually projecting parts or ridges, which form gripper-like parts 17, 18. Instead of gripper-like parts 17, 18 which jut outwardly toward the central axis, it would also be possible to provide openings or profiled structures directed away from the central axis, if correspondingly shaped fasteners 6 or correspondingly shaped fastener heads 5 are to be seized. In this case, appropriately projecting raised structures, pegs or the like would then be provided on fastener heads 5. It would also be conceivable for the raised structures, pegs or the like to project beyond the circumference of a shoulder 10 on fastener head 5.

In the foregoing description, it was mentioned that extensions of a tool drive are provided on gripper-like parts 17, 18 or on corresponding openings or profiled structures. Within the scope of the invention, it is also possible to form such extensions of a tool drive in the region of incisions 15, 16, recesses or the like or adjoining these but offset in axial direction. Naturally it would also be conceivable to provide two or more incisions 15, 16 on the jaws as viewed in axial direction, if a fastener head 5 were to be provided, for example, with two or more shoulders 10 disposed at successive intervals in axial direction.

In this connection, it would be further conceivable to provide the gripper-like parts or pegs directed appropriately toward the central axis or openings or profiled structures directed away from this central axis in the immediate region of incisions 15, 16, so that then even fasteners 6 provided only with a kind of shoulder 10, on which projections or depressions or pegs and holes are provided directly, can be held on fastener head 5. In such an embodiment, the jaws would then correspond to the form of shoulder 10 of fastener head 5, and mechanical and/or frictional locking would be achieved by the mutually engaging raised structures and projections. In this case also a holder which can be fixed as viewed in axial direction can be provided for fastener head 5 in the screwing element. If gripper-like parts 17, 18 are present and these parts engage with shoulder 10 of a fastener head 5 from behind, then a corresponding portion 12 must be present in some form in order to create the space defined by length B between the bearing face of fastener head 5 and the beginning of shoulder 10.

Instead of portion 12, it is naturally also possible to insert at this place an appropriate washer with diameter smaller than that of shoulder 10, so that a fastener head can be clamped in a screwing element according to the invention in this case also.

Figure 3:
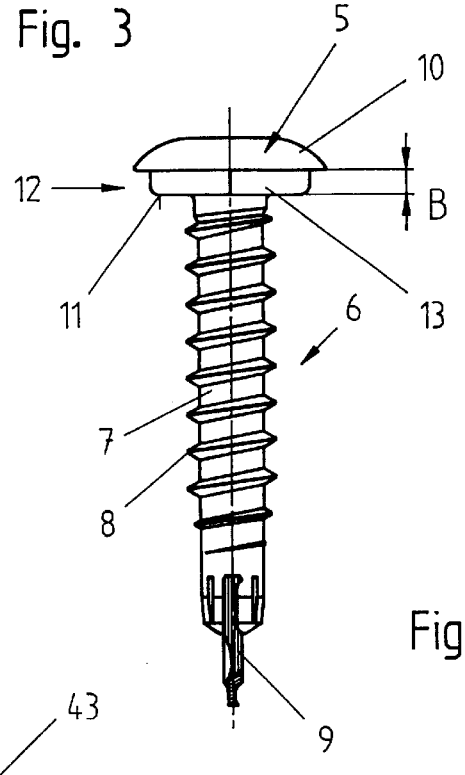
FIG. 3 shows an elevation of a fastener, which can be set with a screwing element according to the invention.

Precisely in such an embodiment, although also in embodiments with a one-piece screw head as illustrated in FIG. 3, it is conceivable to form, at the center between jaws 3, 4, a tool for an internal drive in addition to jaws 3, 4 holding fastener head 5. In this case a corresponding internal drive would be formed in fastener head 5, and so the corresponding tool can also be formed or disposed, for example, at the free end of stud 30, which is slidable in tubular holder 2.

In the foregoing description there have been explained practical examples in which jaws 3 and 4 are axially slidable in a tubular holder 2, and specifically from an open position to a closed position, wherein mechanical and/or frictional positioning of jaws 3, 4—possibly together with a corresponding stud 30—is also achieved by the axial sliding process. Within the scope of the invention, however, it is also conceivable to dispose jaws 3, 4 in a different embodiment of a tubular holder 2, wherein jaws 3, 4 would then no longer be axially slidable relative to holder 2. The open position would then be brought about solely by application of radial force or by loosening jaws 3, 4 to permit radial mobility, or jaws 3, 4 could be brought into closed position by appropriate turning of, for example, sleeve parts. In this connection it would also be conceivable to hold jaws 3, 4 axially immovably relative to a spud 43, which can be inserted in a screwing device, wherein tubular holder 2 could then be withdrawn exactly in the direction of arrow 14, in order thereby to pivot jaws 3, 4 into open position. From the structural viewpoint, therefore, extremely diverse embodiments are possible.

What is claimed is:

1. A screwing element for holding and for forcibly turning a fastener (6), comprising a plurality of jaws (3, 4), which are disposed in succession in circumferential direction for seizing the fastener (6), wherein the jaws (3, 4) engage in a tubular holder (2) and, in combination with this holder (2), in a first end position are extended beyond the holder (2) and forced radially apart for the purpose of receiving the fastener head, and in a second end position are retracted and radially squeezed together inside the holder (2), characterized in that incisions (15, 16) or recesses are formed on the free and region of the jaws (3, 4) for mechanical and/or frictional accommodation of the fastener head (5), in that gripper-like parts (17, 18) jutting outwardly toward the central axis (24) or directed away therefrom are formed on the free end of the jaws (3, 4) adjoining the incisions (15, 16) or recesses, for the purpose of additional mechanical and/or frictional seizing of portions of the fastener head (5), in that an axially reciprocal means is provided for alternately extending said jaws and forcing them radially apart or retracting them and radially squeezing them together, and in that an axially reciprocable means is provided responsive to axial pressure by a received fastener head to retract the jaws (3, 4) from the first to the second end position.

2. A screwing element according to claim 1 characterized in that said axially reciprocable means is responsive to an axial pull on the jaws by a received fastener head to extend the jaws (3, 4) from the second to the first end position.

3. The screwing element according to claim 1 characterized in that said axially reciprocable means is adapted to operate in snap-acting manner.

* * * * *